United States Patent [19]

Shaw et al.

[11] Patent Number: 4,657,669

[45] Date of Patent: Apr. 14, 1987

[54] DEPRESSANTS FOR FROTH FLOTATION

[75] Inventors: Peter Shaw, Randburg; Jan Coetzee, Pretoria, both of South Africa

[73] Assignee: Sentrachem Limited, Marshalltown, South Africa

[21] Appl. No.: 757,513

[22] Filed: Jul. 19, 1985

Related U.S. Application Data

[62] Division of Ser. No. 504,533, Jun. 15, 1983, abandoned.

[30] Foreign Application Priority Data

Jun. 17, 1982 [ZA] South Africa ..... 82/4283

[51] Int. Cl.[4] ..... B03D 1/14

[52] U.S. Cl. ..... 209/167; 252/61

[58] Field of Search ..... 209/166, 167; 252/61; 75/2

[56] References Cited

U.S. PATENT DOCUMENTS

| | | | |
|---|---|---|---|
| 4,268,380 | 5/1981 | Shaw | 209/167 |
| 4,329,223 | 5/1982 | Ramordai et al. | 209/167 |
| 4,416,770 | 11/1983 | Bresson | 209/167 |

FOREIGN PATENT DOCUMENTS

| | | | |
|---|---|---|---|
| 1070034 | 1/1980 | Canada | 209/167 |
| 554887 | 5/1977 | U.S.S.R. | 209/166 |

*Primary Examiner*—Bernard Nozick

*Attorney, Agent, or Firm*—Ladas & Parry

[57] ABSTRACT

The invention concerns the use of 5-hydroxy-3-thiazolidine-2-thiones of the structure I

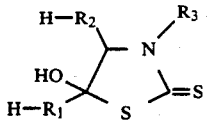

I where $R_1=(CHOH)_m$, $R_2=(CHOH)_n$ where $(m+n)=0$ to 6, and $R_3$ is alkyl or hydroxy-alkyl as depressants in the flotation of mixtures of base metal minerals, particularly those containing molybdenum, copper, lead, zinc; and to flotation processes using these compounds.

7 Claims, No Drawings

DEPRESSANTS FOR FROTH FLOTATION

This is a divisional of co-pending application Ser. No. 504,533 filed on June 15, 1983, now abandoned.

FIELD OF THE INVENTION

This invention relates to the reagents used in the concentration of minerals by froth flotation, and in particular to the reagents known as depressants useful in selective recovery of base-metal minerals from their ores.

BACKGROUND OF THE INVENTION

In the commercial concentration of metal sulphides from ores by froth flotation, one or more reagents are often needed which selectively depress one or more of these sulphides from a mixture, thereby permitting the separate recovery of other components of the mixture during or after their concentration from gangue minerals.

Two examples of such process and known useful reagents are:

1. The recovery of molybdenite from copper sulphide concentrates containing minor amounts of molydenum is commonly effected by addition copper sulphide depressants such as the product obtained from reaction of arsenic trioxide with sodium sulphide (U.S. Pat. No. 3,655,044), or phosphorus pentasulphide and sodium hydroxide. Other known reagents are thioglycerol (U.S. Pat. No. 3,785,481), choline xanthate (U.S. Pat. No. 3,788,467), and metal cyanides.

2. The recovery of zinc sulphide from a common type of complex sulphide ore containing two or more of copper, lead and zinc sulphides cannot be achieved until it has been activated with a solution of a copper salt, and its recovery follows that of copper and lead. However, a portion of the lead sulphide is recovered with the copper sulphides, and its rejection requires a further flotation stage using a lead depressant such as a dichromate salt.

OBJECT OF THE INVENTION

It is an object of the present invention to provide a new class of selective depressants useful in the separation of base-metal minerals, and particularly base-metal sulphides, and more particularly those containing copper sulphides.

THE INVENTION

According to the invention there is provided 5-hydroxy 3-thiazolidine 2-thiones of the structure I as selective depressants of base-metal minerals, such as base-metal sulphide minerals and especially copper sulphides.

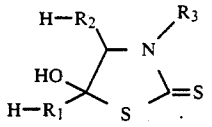

I where $R_1=(CHOH)_m$, $R_2=(CHOH)_n$ where $(m+n)=0$ to 6, and $R_3$ is alkyl or hydroxy-alkyl.

In a preferred form of the invention this class of selective depressants is used in the treatment of non-sulphide minerals which have been reacted with a soluble metal sulphide or hydrosulphide in a sulphidising step.

The scope of the present invention also extends to a flotation process in which compounds I are used alone or in combination with other flotation reagents, including other depressants, to permit the separation of mixtures of more than one base-metal mineral, especially base-metal sulphides.

Compound I may conveniently be synthesised from an aminocarbonyl compound of structure II, or a hydroxy-imine of structure III, by reaction with carbon disulphide.

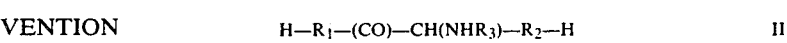

II

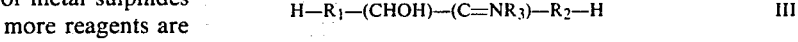

III

Compound II where $(m+n)>0$ is an aminodeoxysaccharide, and the use of compounds I derived from such aminodeoxysaccharides, especially those derived from pentoses and hexoses, is preferred embodiment of the invention.

Compound III is conveniently synthesised from a sugar and ammonia or a primary amine in an appropriate solvent, and the use of compounds I thus derived from sugars and ammonia or a primary amine, especially those derived from pentoses and hexoses, is a further preferred embodiment.

It has been found that compounds I prepared by either route are effective for the use described.

EXAMPLES

Convenient examples of compound I are 3-alkyl 5-hydroxy 5-D-arabino tetrahydroxybutyl 3-thiazolidine 2-thiones, where $m=4$, $n=0$, and $R_3$ is identified in the specific examples.

EXAMPLE 1

A sample of a copper sulphide ore from the north-eastern Transvaal assaying 0,4% copper was wet-milled and subjected to batch flotation at pH8, using a collector potassium amyl xanthate at 30 grams per ton dry ore (g/t), and as frother "Senforth" TEB (a commercial mixture of acetals marketed by Sentrachem Limited) at 45 g/t. The test depressant was added at 20 g/t and the pulp conditioned for 3 minutes before flotation. A reference test with no depressant was made. Concentrates and tailings were assayed for copper, and the recovery of copper calculated.

| $R_3$ | Copper Grade % Concentrate | Copper Tailing | Copper Recovery % |
|---|---|---|---|
| Methyl | 13,8 | 0,13 | 69 |
| Ethyl | 19,0 | 0,11 | 74 |
| 2-hydroxyethyl | 13,4 | 0,12 | 66 |
| Reference | 19,9 | 0.08 | 84 |

Copper recovery is shown to be markedly reduced by the compounds I when applied at a concentration similar to that of the strong collector used.

EXAMPLE 2

A sample of a porphyritic copper/molybdenum ore from northern Chile was wet-milled and subjected to batch flotation at pH5, using as collector a mixture of "Minerec" T-3010 (a composition including xanthogen formate and marketed by Sentrachem Limited) and diesel fuel in the proportion 4:1 at a level of 100 g/t, and as frother "Dowfroth" 1012 (a composition containing polypropyleneglycol monomethyl ether and marketed by Dow Chemical Co.) at 60 g/t. The concentrate was resuspended in water at pH6, treated with the test depressant ($R_3$=methyl) at 55 g/t (based on the concentrate) for 3 minutes, and again subjected to batch flotation. The concentrate and tailing from this test were assayed for copper and molybdenum, and the recovery of each element calculated.

| Element | Grade % Concentrate | Grade % Tailing | Recovery % |
|---|---|---|---|
| Copper | 36,4 | 16,6 | 23 |

The partial selective depression of copper sulphides and resultant improvements in molybdenum grade is demonstrated.

EXAMPLE 3

A sample of a complex sulphide ore assaying 0,53% copper, 9,5% lead, and 2,6% zinc was wet-milled with a depressant reagent at pH8 and subjected to batch flotation using as collector "Senkol" 50 (a composition containing sodium mercaptobenzthiazole and marketed by Sentrachem Limited) at 20 g/t and as frother methylisobutyl carbinol at 50 g/t. The depressant of the invention ($R_3$=methyl) at 100 g/t was compared with zinc sulphate at 500 g/t in a reference test. Concentrates and tailings were assayed for copper, lead and zinc, and the metal recoveries calculated.

| Depressant | Level (g/t) | Concentrate grades (%) Copper | Lead | Zinc | Recoveries (%) Copper | Lead | Zinc |
|---|---|---|---|---|---|---|---|
| $R_3$ = methyl | 100 | 2,08 | 49,4 | 5,07 | 56 | 70 | 26 |
| $ZnSO_4$ | 500 | 2,72 | 26,7 | 4,09 | 86 | 72 | 26 |

The selectivity of the depressant is shown by the unchanged zinc recovery, slightly reduced lead recovery, and substantially reduced copper recovery compared with the reference $ZnSO_4$.

EXAMPLE 4

A sample of a bulk copper-molybdenum sulphide concentrate containing approximately 0,7% Mo and 35% Cu was obtained from the same source as the ore in Example 2. The material as 40% solids suspension was conditioned for one minute with kerosine (150 g/t) and the same test reagent as Example 2, and then subjected to batch flotation for 7 minutes.

| Test Reagent (g/t) | Concentrate Grade (% Mo) | Recovery Mo % | Recovery Cu % |
|---|---|---|---|
| 0 | 0,8 | 66 | 53 |
| 140 | 2,9 | 87 | 17 |
| 180 | 4,0 | 82 | 11 |

The effectiveness of the reagent for the selective flotation of molybdenum from a bulk copper-molybdenum sulphide concentrate is shown.

We claim:

1. A process for the separation of copper sulfide from a material containing molybdenum, lead, or zinc and copper sulfide or a sulfidized material containing copper and one or more of lead, molybdenum or zinc comprising (a) depressing the copper sulfide with a depressant chosen from compounds of the general formula

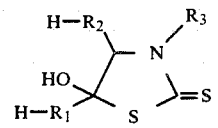

in which $R_1=(CHOH)_m$, $R_2=(CHOH)_n$ where $(m+n)=0$ to 6, and $R_3$ is alkyl or hydroxy-alkyl;

(b) in the presence of a collector and (c) recovering the molybdenum, lead or zinc in the froth.

2. A flotation process as in claim, 1 wherein said batch flotation takes place at a pH of about 8.

3. A flotation process, as in claim 1 wherein the collector used is a composition containing sodium mercaptobenzothiazole.

4. A process, as in claim 1, wherein the collector is potassium amyl xanthate.

5. A process, as in claim 1, wherein the forther is a composition containing polypropyleneglycol monomethyl ether.

6. A process, as in claim 1, wherein the frother is methylisobutyl carbinol.

7. A process, as in claim 1, wherein the ores are conditioned with kerosene before subjection to batch flotation.

* * * * *